US009982886B2

(12) United States Patent
Taylor

(10) Patent No.: US 9,982,886 B2
(45) Date of Patent: May 29, 2018

(54) FLUE GAS RECYCLE SYSTEM WITH FIXED ORIFICES

(75) Inventor: Curtis Taylor, Gaston, IN (US)

(73) Assignee: Honeywell International Inc., Morris Plains, NJ (US)

( * ) Notice: Subject to any disclaimer, the term of this patent is extended or adjusted under 35 U.S.C. 154(b) by 1108 days.

(21) Appl. No.: 13/543,305

(22) Filed: Jul. 6, 2012

(65) Prior Publication Data

US 2014/0007800 A1 Jan. 9, 2014

(51) Int. Cl.

| | |
|---|---|
| ***F23C 9/00*** | (2006.01) |
| ***F23C 9/08*** | (2006.01) |
| ***F23D 14/02*** | (2006.01) |

(52) U.S. Cl.

CPC ..... *F23C 9/08* (2013.01); *F23D 14/02* (2013.01); *F23C 2202/30* (2013.01); *F23C 2202/50* (2013.01)

(58) Field of Classification Search

CPC .... F23C 9/08; F23C 2202/50; F23C 2202/30; F23C 2202/10; F23C 2202/20; F23C 9/06; F23D 14/02; F23L 3/00; F23L 5/02; F23N 1/007; F23N 3/007; F23N 2021/12; F23N 2035/06

USPC ..... 431/115, 12, 9, 116

See application file for complete search history.

(56) References Cited

U.S. PATENT DOCUMENTS

| | | | |
|---|---|---|---|
| 4,206,712 A | 6/1980 | Vatsky | |
| 4,225,305 A | 9/1980 | Hazard et al. | |
| 4,253,403 A | 3/1981 | Vatsky | |
| 5,666,944 A | 9/1997 | Ferguson | |
| 6,385,958 B2 * | 5/2002 | Leone et al. | 60/782 |
| 6,776,609 B1 * | 8/2004 | Sullivan et al. | 431/9 |
| 2007/0224556 A1 | 9/2007 | Springstead | |

FOREIGN PATENT DOCUMENTS

WO 2003081134 A1 10/2003

OTHER PUBLICATIONS

Gerstmann et al., "NOx and CO emissions of a compact premixed gas burner with flue gas recirculation," Proceedings of the Int'l. Joint Power Generation Conf.,1: 169-173 (2001) (Abstract).

Sarv et al., "Selective use of oxygen and in furnace combustion technique for NOx reduction in coal burning cyclone boilers," Babcock & Wilcox Power Generation Group Inc. (Abstract).

* cited by examiner

*Primary Examiner* — Alfred Basichas

(74) *Attorney, Agent, or Firm* — Brooks, Cameron & Huebsch, PLLC

(57) ABSTRACT

A system for providing combustion air and fuel gas to a premix burner includes a premix engine, a premix burner in fluid communication with an outlet of the premix engine, an exhaust flue, a flue gas recirculation line in fluid communication with the flue and an inlet of the premix engine, and a fresh air line in fluid communication with a source of fresh air and the inlet of the premix engine. A flue gas flow restrictor is installed in the flue gas recirculation line, and a fresh air flow restrictor is installed in the fresh air line. The flow restrictors are sized so that the premix engine, in operation, draws recycled flue gas and fresh air from the recycled flue gas line and fresh air line, respectively, in a predetermined proportion.

8 Claims, 1 Drawing Sheet

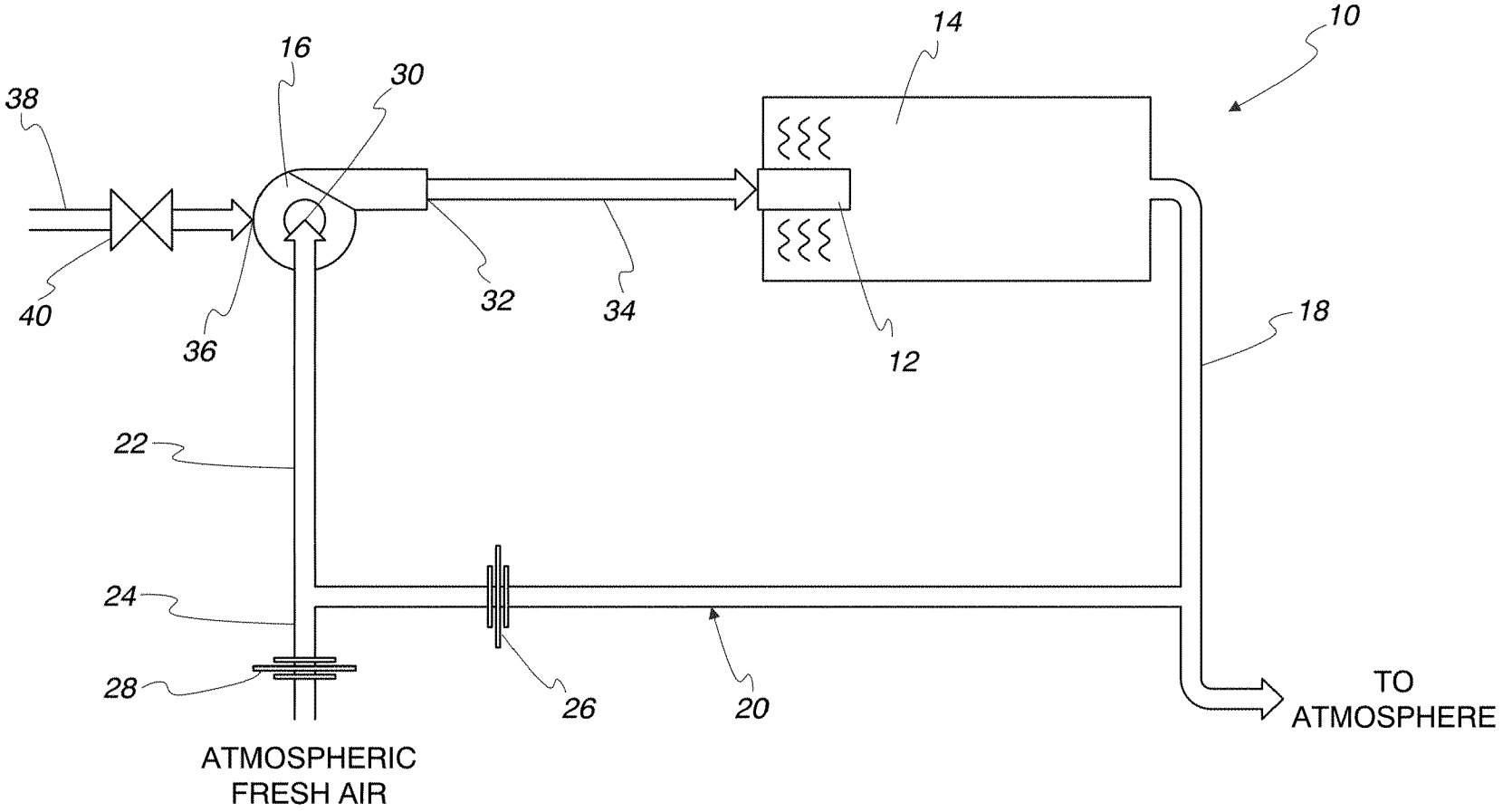
10
14
12
18
TO
ATMOSPHERE
34
20
26
32
30
16
36
38
40
22
24
28
ATMOSPHERIC
FRESH AIR

FLUE GAS RECYCLE SYSTEM WITH FIXED ORIFICES

BACKGROUND AND SUMMARY

The dominant form of burner used in residential and commercial hot water heaters and boilers is the "can-style" premix burner. Can-style premix burners typically are composed of perforated, rolled alloy or metal fiber formed into a "can" shape. The perforations, which have a fixed-geometry, serve as burner ports. The burners are provided with a mixture of fuel gas and combustion air (sometimes referred to herein as a "premix"). The premix includes all of the combustion air and all of the fuel to be combusted in the burner. The premix passes through the ports to a flame zone outside the can where the premix is combusted.

In order to ensure that the fuel is substantially completely burned in the burner and fired chamber, and that unburned fuel is not emitted to the atmosphere, the premix typically includes a sufficient quantity of combustion air to produce an exhaust gas flue reading of about 2-3% excess oxygen after the fuel is burned. This excess oxygen typically is provided as a constituent of an equivalent percentage of excess combustion air. As such, the premix typically includes about 10-15% excess combustion air. In operation, the burners burn the premix and emit water vapor, carbon dioxide, nitrogen, excess combustion oxygen and heat. The foregoing emissions (sometimes referred to herein as "flue gases") are vented through a flue to the atmosphere. A portion of the heat is used to heat the water in the boiler and the rest of the heat is vented to the atmosphere via the flue gases. Other forms of premix burner, for ceramic plate burners, operate in substantially the same way.

One challenge facing the burner industry is to provide a premix burner that produces both low oxides of nitrogen ("NOx") and high thermal efficiency. NOx production increases exponentially with increasing flame temperature. As such, reducing flame temperature can significantly lower NOx production. Known techniques for reducing flame temperature, however, can have an undesirable effect on thermal efficiency. One such technique involves simply providing additional excess combustion air to the premix, so that the premix contains, for example, about 30-40% excess combustion air. The additional excess combustion air provides an additional thermal mass that quenches the burner flame (that is, absorbs heat from the flame) when the fuel is burned, thereby reducing the flame temperature and, consequently, reducing NOx emissions. The heated, excess combustion air is vented to the atmosphere as a flue gas. Although this technique has been effective in reducing NOx emissions, it compromises the burner's thermal efficiency because a substantial amount of heat that otherwise could have been used to heat the water in the boiler is instead transferred to the excess combustion air and lost when the excess combustion air is vented to the atmosphere.

The present disclosure illustrates and describes an exemplary system for controlling NOx production in a premix burner by recycling a portion of the flue gases into the combustion air. The system includes a flue gas recirculation line having a flow restrictor therein, a fresh air line having a flow restrictor therein and means for drawing recycled flue gas and fresh air through the flue gas recirculation line and fresh air line, respectively, in a predetermined ratio.

In the illustrated embodiment, an air/fuel mixing apparatus (sometimes referred to herein as a "premix engine") provides a premix to a premix burner where the premix is combusted. A flue associated with the burner carries flue gases away from the burner. A flue gas recirculation line is in fluid communication with flue and the premix engine so that the premix engine may draw in a portion of the flue gas as a component of the combustion air. More particularly, the flue gas recirculation line is connected at one end to the flue and at the other end to an inlet of the premix engine or an intervening combustion air line. Similarly, a fresh air line is in fluid communication with the atmosphere or another source of fresh air and the premix engine so that the premix engine may draw in fresh air as component of the combustion air. More particularly, the fresh air line is open at one end to the atmosphere or other source of fresh air and connected at the other end to an inlet of the premix engine or an intervening combustion air line. A flue gas flow restrictor is installed in the flue gas recirculation line between the flue and the premix engine or intervening combustion air line. Similarly, a fresh air flow restrictor is installed in the fresh air line between the fresh air supply and the premix engine or intervening combustion air line. The flow restrictors have fixed flow geometry, and they are sized so that the premix engine can draw recycled flue gas from the flue gas recirculation line and fresh air from the fresh line in a predetermined proportion.

Additional features of and modifications to the present disclosure will become apparent to those skilled in the art upon consideration of the following detailed description of illustrative embodiments exemplifying the best mode of implementing the disclosed system as presently perceived.

BRIEF DESCRIPTION OF THE DRAWING

FIG. 1 is a process diagram of a fuel and combustion air system for a premix burner illustrating the premix burner, a flue, a flue gas recirculation line having a flue gas flow restrictor therein, a fresh air line having a fresh air flow restrictor therein, a combustion air line, a fuel gas supply and a premix engine for mixing fresh air and recycled flue gas with fuel gas and supplying the mixture thereof to the burner.

DETAILED DESCRIPTION

FIG. 1 illustrates schematically a fuel and combustion air system 10 for a premix burner 12 as might be used in the fired chamber 14 of a hot water heater or other boiler or heat exchanger. System 10 includes a premix engine 16 having an inlet 30 and an outlet 32. A premix line 34 is connected to outlet 32 of premix engine 16. A gas supply 38 is connected to and in fluid communication with a fuel inlet 36 of premix engine 16. Alternatively, gas supply 38 could be connected to and in fluid communication with premix line 34 downstream of outlet 32 of premix engine 16. In such an embodiment, gas supply 38 may be connected to premix line 34 near the outlet of premix engine 16. In either case, a gas valve 40 may be provided to control the flow of fuel gas from gas supply 38. Premix line 34 also is connected to or is otherwise in fluid communication with burner 12. A flue 18 is associated with burner 12, as would be understood by one skilled in the art. Flue 18 receives the burner emissions (that is, flue gases) from burner 12 and vents them to the atmosphere. A flue gas recirculation line 20 is connected at one end to flue 18 and connected at the other end to a combustion air line 22. A fresh air line 24 is open to the atmosphere or another source of fresh air at one end and connected at the other end to combustion air line 22. An end of combustion air line 22 is connected to inlet 30 of premix engine 16 so that premix engine 16 is in fluid communication with flue 18 through flue gas recirculation line 20 and also in fluid communication with the atmosphere through fresh air line 24.

Combustion air line 22 is illustrated as a pipe or other form of fluid conduit connected to premix engine 16 at one end, to fresh air line 24 at the other end, and to flue gas recirculation line 22, for example, through a tee connection between premix engine 16 and fresh air line 24. In an alternative embodiment, combustion air line 22 could take the form of a manifold connected to fresh air line 24 and flue gas recirculation line 20. In a further embodiment, fresh air line 24 and flue gas recirculation line 20 could be connected directly to inlet 30 (or a plurality of inlets 30) of premix engine 16, in which case combustion air line 22 could be omitted.

A flue gas flow restrictor 26 is installed in flue gas recirculation line 20 between flue 18 and combustion air line 22 (or between flue 18 and inlet 30 in embodiments not including a discrete combustion air line 22). Similarly, a fresh air flow restrictor 28 is installed in fresh air line 24 between the end of fresh air line 24 open to the atmosphere and combustion air line 22 (or between flue 18 and inlet 30 in embodiments not including a discrete combustion air line 22). Flow restrictors 26, 28 are embodied as elements having fixed, non-variable flow geometry. For example, either or both of flow restrictors 26 and 28 could be embodied as orifice plates or other restricting orifices, constrictions molded or otherwise formed into the corresponding lines 20 and 24, or in any other manner providing a fixed, predetermined restriction to flow of recycled flue gas and fresh air, respectively, through flue gas recirculation line 20 and fresh air line 24.

In operation, premix engine 16 draws a vacuum on flue gas recirculation line 20 and fresh air line 24, either through combustion air line 22 (when used) or directly (when combustion air line 22 is omitted). The vacuum on flue gas recirculation line 20 is substantially the same as the vacuum on fresh air line 24. It follows that premix engine 16 draws in combustion air in the form of recycled flue gas from flue gas recirculation line 20 and fresh air from fresh air line 24 in a predetermined ratio. The predetermined ratio is determined by the relative sizing of flue gas recirculation line 20, flue gas flow restrictor 26, fresh air line 24 and fresh air flow restrictor 28, as would be understood by one skilled in the art. In an illustrative embodiment, the predetermined ratio of recycled flue gas to fresh air is about 15:85. In this embodiment, the combustion air oxygen concentration would be about 18.2%. For comparison, the oxygen concentration of fresh air is about 20.9%. In other illustrative embodiments, the predetermined ratio of recycled flue gas to fresh air could be anywhere in the range of about 10:90 to about 25:75. In further embodiments, the predetermined ratio of recycled flue gas to fresh air could be less than 10:90 or greater than 25:75.

In embodiments wherein fuel gas is supplied to premix engine 16 through fuel inlet 36, the fuel gas and combustion air are mixed together within premix engine 16 and the resulting premix is discharged into premix line 34 through outlet 32. Some mixing of fuel gas and combustion air may continue to occur in premix line 34, as well. In embodiments wherein fuel gas is supplied to premix line 34 downstream of outlet 32, premix engine 16 discharges the combustion air into premix line 34 through outlet 32, fuel gas is injected or otherwise provided to premix line 34, and the fuel gas and combustion air are mixed in premix line 34. In either case, the resulting premix is provided to burner 12, where it is combusted.

Premix engine 16 is shown in FIG. 1 as a blower driven by a variable-frequency drive (i.e., variable speed) electric motor (not shown). Alternatively, the blower could be driven by a single speed motor. In either case, premix engine 16 may operate at a speed or range of speeds that provides for adequate mixing of fresh air and recycled flue gas in combustion air line 22 and/or premix engine 16. Also, premix engine 16 may operate at a speed or range of speeds that provides for adequate mixing of combustion air and fuel gas in premix engine 16 and/or premix line 34. Further, although the volume of recycled flue gas and fresh air drawn into premix engine 16 will vary as a function of the premix engine blower speed, the ratio of recycled flue gas to fresh air drawn by premix engine 16 may be generally independent of blower speed, at least under normal, steady-state conditions wherein the premix is being combusted in burner 12.

Premix burner 12 can be embodied in any suitable form, as would be recognized by one skilled in the art. For example, premix burner 12 can be embodied as a can-style burner, as described above. Alternatively, premix burner 12 could be embodied as a ceramic plate burner, which has a plate-like, rather than can-like, shape, but which also includes fixed-geometry ports and which operates in manner similar to a can-type premix burner. Premix burner 12 could be embodied in other forms, as well, as would be recognized by one skilled in the art.

Rather than relying solely on excess fresh air to quench the flame, the disclosed system uses a predetermined concentration of recycled flue gas to contribute to the quenching effect. Flue gas has a greater water vapor and carbon dioxide content than fresh air alone. Also, flue gas has a lesser oxygen content than fresh air alone. As such, combustion air including a flue gas component has a greater water vapor and carbon dioxide content than a similar quantity of combustion air including only fresh air, and a lesser oxygen content than a similar quantity of combustion air including only fresh air.

Water vapor and carbon dioxide have relatively high specific heat and relatively low mass compared to fresh air. As such, a given mass of recycled flue gas flowing past the burner tends to absorb more heat from the flame and thereby depress the flame temperature more than an equivalent mass of fresh air. Accordingly, a given reduction in flame temperature can be achieved using a lesser mass of combustion air including a recycled flue gas component than combustion air including fresh air alone. It follows that use of combustion air including a recycled flue gas component can result in less loss of heat to the atmosphere and, therefore, greater thermal efficiency, compared to use of combustion air including only fresh air. Also, the lesser oxygen content of combustion air including a flue gas component yields slower burning of the fuel gas, which also helps to reduce the flame temperature. At least these two factors may contribute to improved NOx emissions and thermal efficiency.

Although a few embodiments have been described in detail above, other modifications are possible. For example, the various lines and flow restrictors, as well as the means for premixing combustion air and fuel and providing the premix to the premix burner, may be embodied in other ways. Other embodiments may be within the scope of the following claims.

The invention claimed is:

1. A system for providing combustion air and fuel to a premix burner, the apparatus comprising:

a premix burner;

a premix engine having:

a combustion air inlet;

an outlet; and
a blower;

a premix line in fluid communication with the outlet of the premix engine and with the premix burner;

a fuel gas inlet associated with the premix engine;

a flue in fluid communication with the premix burner, the flue configured to convey flue gas from the premix burner;

a flue gas recirculation line in fluid communication with the flue and the combustion air inlet of the premix engine, the flue gas recirculation line including a fixed-geometry non-variable flue gas flow restrictor between the flue and the inlet of the premix engine; and a fresh air line in fluid communication with a source of fresh air and the combustion air inlet of the premix engine, the fresh air line including a fixed-geometry non-variable fresh air flow restrictor between the source of fresh air and the inlet of the premix engine;

wherein the flue gas flow restrictor and the fresh air flow restrictor being sized to enable the premix engine to draw flue gas, fuel gas, and fresh air in a predetermined ratio independent of a speed of the blower; and a volume of the fresh air and the flue gas varies based only on the speed of the blower.

2. The system of claim 1 wherein the fuel gas inlet is configured to provide fuel gas to the premix engine.

3. The system of claim 1 wherein the fuel gas inlet is configured to provide fuel gas to the premix line.

4. The system of claim 1 wherein at least one of the flue gas flow restrictor and fresh air flow restrictor is a restricting orifice.

5. The system of claim 1 wherein at least one of the flue gas flow restrictor and fresh air flow restrictor is an orifice plate.

6. The system of claim 1 wherein the predetermined ratio of flue gas to fresh air is between about 10:90 and about 25:75.

7. The system of claim 6 wherein the predetermined ratio of flue gas to fresh air is about 15:85.

8. A system for providing combustion air and fuel to a premix burner, the apparatus comprising:

a premix burner;

a premix engine having:

a combustion air inlet;
an outlet; and
a blower;

a premix line in fluid communication with the outlet of the premix engine and with the premix burner;

a fuel gas inlet associated with the premix engine;

a flue in fluid communication with the premix burner, the flue configured to convey flue gas from the premix burner;

a flue gas recirculation line in fluid communication with the flue and the combustion air inlet of the premix engine, the flue gas recirculation line including a fixed-geometry non-variable flue gas flow restrictor between the flue and the inlet of the premix engine; and a fresh air line in fluid communication with a source of fresh air and the combustion air inlet of the premix engine, the fresh air line including a fixed-geometry non-variable fresh air flow restrictor between the source of fresh air and the inlet of the premix engine;

wherein:

the flue gas flow restrictor and the fresh air flow restrictor being sized to enable the premix engine to draw flue gas, fuel gas, and fresh air in a predetermined ratio independent of a speed of the blower;

a volume of the fresh air and the flue gas varies based only on the speed of the blower; and the flue gas passes through the flue gas flow restrictor and the fresh air passes through the fresh air flow restrictor before mixing in a combustion air line.

* * * * *